US005996734A

United States Patent [19]

Lam et al.

[11] Patent Number: 5,996,734

[45] Date of Patent: Dec. 7, 1999

[54] AIR INTAKE SILENCER FOR A TWO-STROKE ENGINE

[75] Inventors: Edward Lam, Wadsworth; Brian McGuire, Antioch, both of Ill.; Clarence Blanchard, Kenosha, Wis.; William L. Richter, Jr., Antioch, Ill.

[73] Assignee: Outboard Marine Corporation, Waukegan, Ill.

[21] Appl. No.: 09/038,418

[22] Filed: Mar. 11, 1998

[51] Int. Cl.[6] ..... F01N 1/24

[52] U.S. Cl. ..... 181/255; 181/229

[58] Field of Search ..... 181/249, 250, 181/251, 252, 255, 256, 257, 240, 229, 224

[56] References Cited

U.S. PATENT DOCUMENTS

| | | | |
|---|---|---|---|
| 550,228 | 3/1895 | Ukai et al. | 181/250 |
| 2,297,046 | 9/1942 | Bourne | 181/250 |
| 3,511,337 | 5/1970 | Pease et al. . | |
| 3,616,721 | 11/1971 | Laukhuff . | |
| 4,136,756 | 1/1979 | Kawamura . | |
| 4,197,922 | 4/1980 | Weber et al. . | |
| 4,233,812 | 11/1980 | Leistritz . | |
| 4,734,070 | 3/1988 | Mondek . | |
| 4,834,214 | 5/1989 | Feuling . | |
| 5,014,816 | 5/1991 | Dear et al. . | |
| 5,699,763 | 12/1997 | Phillips et al. . | |

FOREIGN PATENT DOCUMENTS

| | | |
|---|---|---|
| 533262 | 3/1955 | Italy . |

*Primary Examiner*—Khanh Dang
*Attorney, Agent, or Firm*—Armstrong Teasdale LLP

[57] ABSTRACT

An air intake noise suppression device comprises a housing defining a passage having a relatively small height, preferably no greater than one-half inch, and a length defined by the expression $$L = H \times \frac{1128}{f}$$

where H is the height of the passage and f is the desired noise frequency to be suppressed. The width of the passage is selected to be large enough to provide an adequate supply of intake air to the engine. With the passage essentially defining a relatively narrow slot, it is filled with acoustic boundary layers that accentuate noise significantly over a relatively wide frequency range.

12 Claims, 2 Drawing Sheets

AIR INTAKE SILENCER FOR A TWO-STROKE ENGINE

BACKGROUND OF THE INVENTION

1. Field of the Invention

The present invention relates generally to an air intake silencer device for a two-stroke engine and, more particularly to an air intake silencer device which by virtue of its construction has the capability of silencing air intake of a two-stroke engine to a degree far greater than previously known silencer devices and which can readily fit within a small space of an engine's overall geometry.

2. Description of the Related Art

Two-stroke engines of the type used in the marine, recreational, construction and lawn maintenance industries, for example, characteristically exhibit high noise levels due in large part to air intake function. In an outboard motor, as an example, which is running at open throttle conditions, a noise level of at least 90 dB can be experienced proximate the motor. Approximately one-half of this noise is generally attributable to the function of the motor's air intake system.

Devices are known for suppressing air intake noise in two-stroke engines. A common form of such a device is simply a chamber through which the intake air passes before being distributed to the engine carburetors, or air throttle bodies in the case of a fuel injected engine. While these devices serve to attenuate some air intake noise, they are generally not completely effective in suppressing the high levels of noise that can be experienced in two-stroke engines. Further, to be effective to some degree they must necessarily be constructed to be rather large in size which is disadvantageous where minimum size overall engine geometry is preferred.

Accordingly, it is desirable to provide an air intake silencer for a two-stroke engine wherein the silencer exhibits a relatively high degree of noise suppression. It is further desirable to provide such a silencer which is capable of occupying a relatively small amount of space and can fit compactly into an engine's overall geometry. Still further, it is desirable to provide such a silencer which is readily constructed by conventional manufacturing methods.

SUMMARY OF THE INVENTION

The present invention improves over the prior art by providing an air intake noise suppression device comprising a housing defining a passage having a relatively small height, preferably no greater than about one-half inch, and a length defined by the expression $$L = H \times \frac{1128}{f} \text{(ft)}$$

where H is the height of the passage and f is the desired noise frequency to be suppressed. The width of the passage is selected to be large enough to provide an adequate supply of intake air to the engine. With the passage essentially defining a relatively narrow slot, it is filled with acoustic boundary layers that attentuate noise significantly over a relatively wide frequency range.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
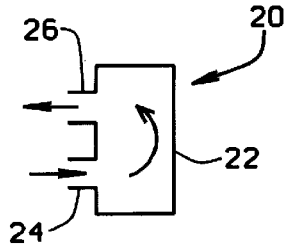
FIG. 1 PRIOR ART
FIG. 1 is a side schematic view of a prior art air intake noise suppression device for a two-stroke engine.

Referring now to the drawings, and initially to FIG. 1, a prior art air intake silencer for a two-stroke engine is designated generally by the reference numeral 20. This device 20 comprises an enlarged chamber 22 having an air inlet 24 and an air outlet 26 which is connectable to a carburetor or air throttling body of a two-stroke engine. The outlet 26 may also be connected to a manifold (not shown) in the case of use on multiple cylinder engines.

Figure 2:
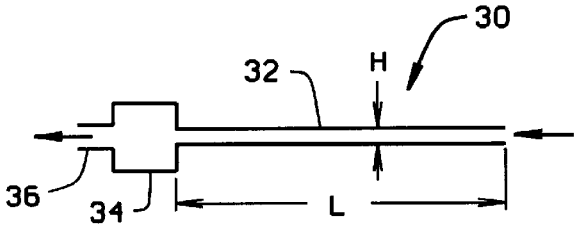
FIG. 2 is a side schematic view of one form of air intake noise suppression device constructed in accordance with the principles of the invention.
Figure 3:
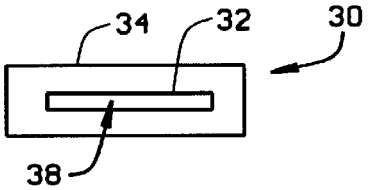
FIG. 3 is a front schematic view of the device of FIG. 1.

Turning to FIGS. 2 and 3, an air intake noise suppression device constructed in accordance with the invention is designated generally by the reference numeral 30 and includes as a principal component a housing 32 which may be connected to a manifold 34 having an air outlet 36 for supplying intake air to a plurality of carburetors and air throttling bodies of an engine. The housing 32 is readily manufactured by suitable methods and can be seen in FIG. 2 to define a somewhat narrow slot or intake passage 38.

In accordance with the invention, the passage 38 is tuned to the quarter-wavelength of the desired noise frequency to be suppressed. This obeys generally recognized pipe acoustic calculations. For instance, if it is desired to suppress frequencies in the 400 Hz range, and with the velocity of sound in normal air as 1128 feet per second, the length of the passage would be determined by the following expression:

$$L = H \times \frac{1128}{400} \text{(ft)}$$

where H is the height of the passage. For a passage height of 0.25 inches, for example, this expression would yield a passage length of 8.5 inches. In addition, it is important that the height of the passage be narrow enough such that the passage is filled with acoustic boundary layers created by the passage walls. Thus, the acoustic particle velocities from the noise are by the viscous effects in the acoustic boundary layers. The effect is not only to attenuate noise at the selected frequency, but also attenuate noise to some degree in a fairly broad band around the selected frequency. This form of damping is also advantageous in reducing the peak velocity of pulsating air flows that are known to be troublesome to carburation and other air intake systems. In practice, we have found that a passage height suitable to create the aforementioned boundary layers for most intake systems of two-stroke engines is about 0.25 inch and cannot exceed about one-half inch without attenuation falling off dramatically. Naturally, the cross-sectional area of the intake passage is selected such that adequate air supply to the engine is satisfied. For most two-stroke engines, it is desirable to suppress intake noise within a range of between 200 and 800 Hz. In such cases, the length of the suppressor will be in a range of approximate eight to fourteen inches.

Figure 4:
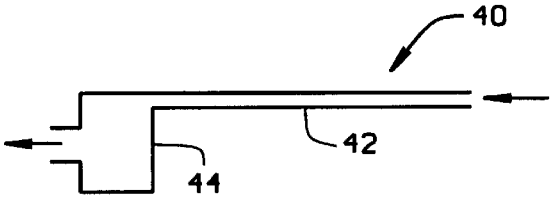
FIG. 4 is a side schematic view of another form of the present noise suppression device.
Figure 5:
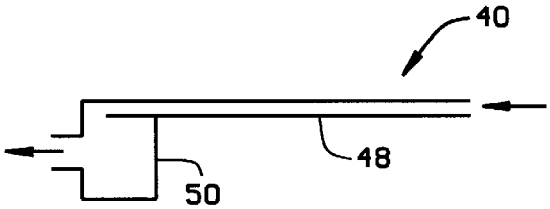
FIG. 5 is a side schematic view of another form of the present noise suppression device.
Figure 6:
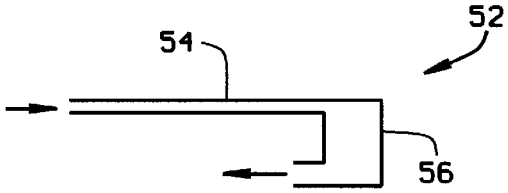
FIG. 6 is a side schematic view of another form of the present noise suppression device suitable for use with an in-line engine.
Figure 7:
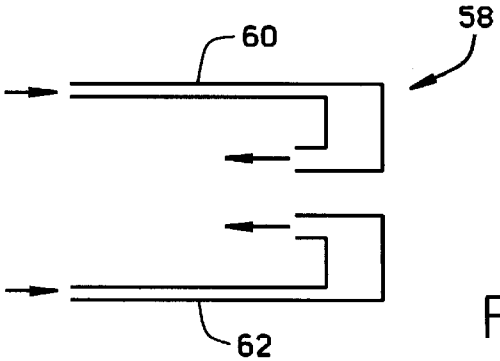
FIG. 7 is a side schematic view of another form of the present noise suppression device suitable for use with a V-engine.
Figure 8:
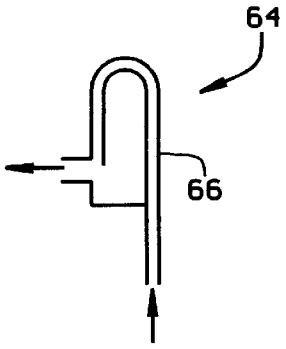
FIG. 8 is a side schematic view of another form of the present noise suppression device.
Figure 9:
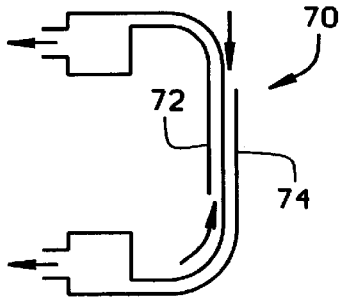
FIG. 9 is a side schematic view of another form of the present noise suppression device.
Figure 10:
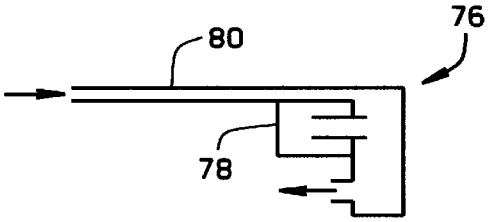
FIG. 10 is a side schematic view of another form of the present noise suppression device including a resonator.

The noise suppression device of the present invention can be configured in a variety of forms depending on the engine application and overall engine geometry desired. For example, FIG. 4 shows a schematic view of an air intake device 40 wherein a slot-passage housing 42 is offset from the center of a manifold 44. FIG. 5 shows a device 46 wherein a slot-passage housing 48 intrudes into a manifold 50. Such a construction may be found advantageous wherein engine space considerations are critical. Also, a narrow air gap between the housing 48 and manifold 50 offers the additional benefit of noise suppression derived from the acoustic impedance created at the junction. FIG. 6 shows a device 52 wherein air enters a slot-passage housing 54 and is reversely directed by a manifold 56. FIG. 7 shows a device 58 wherein two slot-passage housings 60, 62 are provided. This configuration may be suitable, for example, for use on a V-engine. FIG. 8 shows a device 64 wherein a slot-passage housing 66 is formed with curvature. Such a device 64 is particularly suitable where engine space limitations are critical. FIG. 9 shows a device 70 having multiple curved slot-passage housings 72, 74. Further, FIG. 10 shows a device 76 which incorporates a resonator 78 after a slot-passage housing 80 to achieve enhanced performance by affording some additional narrow-band noise attenuation.

Figure 11:
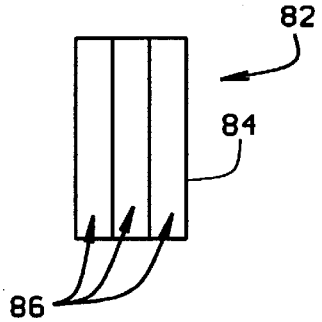
FIG. 11 is a front view of another form of the present noise suppression device including multiple inlet passages.
Figure 12:
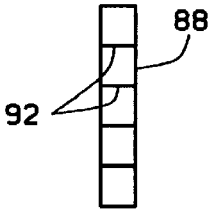
FIG. 12 is a front view of a form of the noise suppression device having a divided wall slot-passage.
Figure 13:
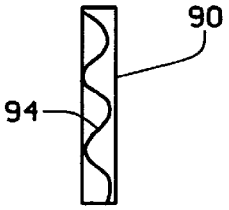
FIG. 13 is a front view of a form of the noise suppression device having a corrugated insert in the slot-passage.
Figure 14:
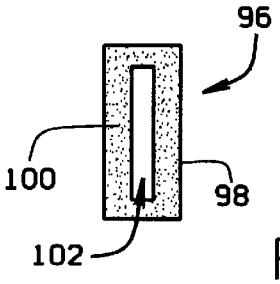
FIG. 14 is a front view of another form of the present noise suppression device wherein the intake passage is formed by a sound absorptive material.

Depending upon the intake air requirements of the particular engine, as well as space considerations, a device 82, as shown in FIG. 11 may be employed wherein a housing 84 is designed with multiple stacked slot-passages 86. Further, as shown in FIGS. 12 and 13 the slot passage 88 and 90, respectively, may be divided by interior walls 92 or a corrugated insert member 94 affording further noise attenuation. Also, as shown in FIG. 14, a device 96 may be constructed having an enlarged housing 98 lined with suitable sound absorptive material 100 such as foam defining a slot-passage 102 to provide additional noise attenuation.

It can now be appreciated that an air intake noise suppression device of the various constructions illustrated in the figures offers considerable advantages over prior art air intake silencers. In practice we have found that with the present air-slot construction, intake noise levels of two-stroke outboard motors can be reduced by more than 10 dB. Moreover, a construction can be selected for a variety of engine configurations wherein the present device occupies very little space in the overall engine geometry thus providing for compact engine design and pleasing appearance.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. An air intake noise suppression device for a two-stroke engine comprising:

a housing including an internal air intake passage having open opposed ends for admitting intake air to said engine;

said air intake passage having a height no greater than about one-half inch and having a length defined by the expression $$L = H \times \frac{1128}{f}$$

where H is the height of the passage and f is a desired noise frequency to be suppressed.

2. The device of claim 1 including a manifold to which said housing is attached.

3. The device of claim 2 wherein said manifold has an interior space and said housing extends into said space.

4. The device of claim 1 wherein said housing is lined with sound absorption material defining said passage.

5. The device of claim 1 wherein said housing defines multiple passages each having a length dimension defined by said expression.

6. The device of claim 1 wherein said housing is configured such that said passage has ends which open in reverse directions.

7. The device of claim 1 wherein said housing is configured such that said passage has ends which open in approximately the same direction.

8. The device of claim 1 wherein the value of f is approximately 200 to 800 Hz.

9. The device of claim 1 wherein the value of L is approximately eight to 14 inches.

10. The device of claim 1 wherein the height of the passage is approximately one-quarter inch.

11. The device of claim 1 wherein said passage is divided by longitudinally extending walls.

12. The device of claim 1 wherein said passage contains a corrugated insert.

* * * * *